United States Patent [19]

Morita et al.

[11] Patent Number: 4,648,916

[45] Date of Patent: Mar. 10, 1987

[54] METHOD OF CONTROLLING COOLING OF HOT-ROLLED STEEL SHEET AND SYSTEM THEREFOR

[75] Inventors: Masahiko Morita; Osamu Hashimoto, both of Kurashiki, Japan

[73] Assignee: Kawasaki Steel Corporation, Hyogo, Japan

[21] Appl. No.: 730,633

[22] Filed: May 6, 1985

[30] Foreign Application Priority Data

Oct. 19, 1984 [JP] Japan ..... 59-219449

[51] Int. Cl.[4] ..... G01B 11/24

[52] U.S. Cl. ..... 148/128; 266/80; 266/90

[58] Field of Search ..... 148/128, 129, 143, 12 R; 266/80, 81, 90, 96, 99; 324/241

[56] References Cited

U.S. PATENT DOCUMENTS

| | | | |
|---|---|---|---|
| 3,473,023 | 10/1969 | Blöch | 148/128 |
| 3,479,506 | 11/1969 | Dörfler | 148/128 |
| 4,440,583 | 4/1984 | Ikegami et al. | 266/80 |

FOREIGN PATENT DOCUMENTS

| | | | |
|---|---|---|---|
| 2371978 | 7/1978 | France | 148/128 |
| 0074240 | 4/1984 | Japan | 266/81 |
| 59-188508 | 10/1984 | Japan . | |

*Primary Examiner*—L. Dewayne Rutledge
*Assistant Examiner*—S. Kastler
*Attorney, Agent, or Firm*—Parkhurst & Oliff

[57] ABSTRACT

In controlling the cooling of a hot-rolled steel sheet after hot rolling, a target value of a transformation rate required for obtaining mechanical properties ultimately expected from the hot-rolled steel plate is previously determined, a rate of gamma to alpha transformed fraction of the hot-rolled steel sheet in a section in which the cooling is controlled is detected by transformed fraction detectors, and an elapsed time from the start of cooling is measured to determine the transformation rate of the steel sheet in a cooling stage, the conditions of cooling being controlled so that the transformation rate can coincide with the target value.

10 Claims, 7 Drawing Figures

Fig.6

| | STEEL | No | TARGET TS (kg/mm²) | TRANSFORMATION RATE (%/sec) | | COILING TEMP. (°C) | | TENSILE PROPERTIES | | |
|---|---|---|---|---|---|---|---|---|---|---|
| | | | | TARGET | ACTUAL RESULTS | TARGET | ACTUAL RESULTS | YS (kg/mm²) | TS (kg/mm²) | El (%) |
| METHOD OF THIS INVENTION | A | 1 | 40 | 7.0 | 6.1~7.7 | — | 650~680 | 29.2 | 39.8 | 45 |
| | | 2 | 43 | 18.0 | 16~20 | — | 510~550 | 35.3 | 42.8 | 42 |
| | | 3 | 45 | 30.0 | 27~34 | — | 480~520 | 37.2 | 45.1 | 38 |
| | B | 4 | 46 | 3.6 | 3.2~4.0 | — | 650~700 | 34.6 | 46.1 | 40 |
| | | 5 | 50 | 8.0 | 7.2~8.8 | — | 550~580 | 38.2 | 50.3 | 37 |
| | | 6 | 55 | 20.0 | 17~22 | — | 460~500 | 41.5 | 55.3 | 35 |
| | C | 7 | 50 | 2.9 | 2.8~3.0 | — | 660~700 | 36.5 | 50.0 | 38 |
| | | 8 | 55 | 5.0 | 4.8~5.6 | — | 550~580 | 39.7 | 55.2 | 35 |
| | | 9 | 60 | 8.5 | 7.5~9.0 | — | 480~520 | 43.3 | 60.2 | 31 |
| | D | 10 | 55 | 2.3 | 2.2~2.4 | — | 670~700 | 39.9 | 54.7 | 37 |
| | | 11 | 60 | 3.6 | 3.4~3.8 | — | 570~610 | 43.7 | 60.2 | 30 |
| | | 12 | 65 | 5.7 | 5.3~6.1 | — | 500~540 | 47.0 | 65.3 | 25 |
| METHOD IN COMPARISION | A | 13 | 40 | — | 5.0~7.5 | 650 | ≦ ±10°C | 28.3 | 39.5 | 44 |
| | | 14 | 43 | — | 13~25 | 540 | 〃 | 35.8 | 43.6 | 40 |
| | | 15 | 45 | — | 20~40 | 480 | 〃 | 38.3 | 44.7 | 37 |
| | B | 16 | 46 | — | 3.3~4.5 | 680 | 〃 | 34.9 | 46.3 | 39 |
| | | 17 | 50 | — | 5.1~9.8 | 580 | 〃 | 37.3 | 48.7 | 37 |
| | | 18 | 55 | — | 12~25 | 490 | 〃 | 42.1 | 54.0 | 32 |
| | C | 19 | 50 | — | 2.8~3.3 | 690 | 〃 | 36.2 | 50.6 | 37 |
| | | 20 | 55 | — | 3.5~5.0 | 580 | 〃 | 39.1 | 54.4 | 35 |
| | | 21 | 60 | — | 6.0~9.2 | 510 | 〃 | 44.2 | 61.3 | 29 |
| | D | 22 | 55 | — | 2.2~2.9 | 680 | 〃 | 39.8 | 55.4 | 34 |
| | | 23 | 60 | — | 2.8~3.5 | 600 | 〃 | 43.0 | 59.2 | 31 |
| | | 24 | 65 | — | 4.5~7.4 | 530 | 〃 | 48.3 | 66.3 | 24 |

METHOD OF CONTROLLING COOLING OF HOT-ROLLED STEEL SHEET AND SYSTEM THEREFOR

BACKGROUND OF THE INVENTION

1. Field of the Invention

This invention relates to improvements in a method of controlling the cooling of a hot-rolled steel sheet after hot rolling and a system therefor.

2. Description of the Prior Art

In response to the aim toward reduced manufacturing cost of steel products, recently, there have been developed methods of producing hot-rolled steel sheets, including the technique of strengthening the transformed structure by the control of cooling after hot rolling as a measure of producing high strength steels in a hot rolled state using a steel material having a low alloy component value or values, the utilization of the technique of refining the crystal grains by the controlled rolling as a measure of simultaneously achieving both the high toughening and highly strengthening of the steels, the combined utilization of both the technique of strengthening the transformed structure and the technique of refining the crystal grains, and so on. There are proposed various techniques concerning the method of controlling the cooling and the conditions of cooling in these cases.

However, in most of these conventional methods, it is common to use the surface temperature of the hot-rolled steel sheet as being a material to be cooled as a control index of the conditions of cooling. In the cases where these methods are used, the following problems are posed:

(1) In measuring the temperature of a steel sheet in an actual system, a radiation pyrometer is normally used. However, it has been known that the radiation pyrometer is basically considered to be unsatisfactory in measuring accuracy, easily affected by the environment of measuring in particular, and easily subjected to measuring errors by steam and splashes of water and further due to the presence of cooling water, etc. remaining on the steel sheet for example, whereby, as a matter of course, there are presented such disadvantages that the positions of measuring the temperature are limited because the measurement of temperature cannot be performed in a cooling zone, the obtained information is not necessarily accurate information because merely the surface temperature is detected, and so on. When the above-described methods are adopted, there is a limit to the accuracy in controlling the conditions of cooling.

(2) As well known, when the steel is transformed from gamma phase to alpha phase, heating due to the transformation latent heat occurs, whereby the apparent specific heat is considerably varied depending on the progress of the transformation of the steel sheet, and, even if the steel sheet is cooled under the same cooling conditions, over-cooling, under-cooling or the like may easily occur depending on a delicate difference in the transformation properties, so that such disadvantages may be presented that a variability in the material quality is increased, evenness in form is deteriorated, or the like. It is well known that the transformation properties are complicatedly varied not only by the difference in the cooling conditions but also by the thermal strain history in the upstream process. In general, the aforesaid variations are usually occurring.

As a consequence, it is apparent that the above-described problems cannot be solved when there is adopted the method of controlling the cooling under the cooling conditions using the temperature as the control index as in the prior art. The most effective measure to obviate the above-described problems is to directly online-detect the behavior of transformation of the steel sheet and adopt a control method based on this information. As proposals concerning the above-described method for example, there are known Japanese Patent laid-Open No. 104754/1975 and Japanese Patent Publication No. 24017/1981.

However, each of the above-described proposals is a method of aiming at controlling the cooling conditions so that the transformation can always occur at a predetermined position when a variation in the transformation properties occurs at a position in the cooling zone, where the transformation occurs. Therefore, the method remains to the extent where slight improvements are applied to the method of using only the temperature as the index of control, as in the prior art. This is due to a deficiency in the means for detecting the behavior of the transformation and, for example, the detecting device proposed in Japanese Patent Laid-Open No. 104754/1975 can detect only the presence of occurrence of a gamma to alpha transformation. Further, in the case of Japanese Patent Publication No. 24017/1981, there is merely adopted an indirect means for detecting a phenomenon of heat-return during the transformation by a thermometer.

As a consequence, the behaviour of transformation of the steel cannot be satisfactorily grasped, therefore the controlling accuracy of the cooling conditions cannot be improved, thus posing the problem in the homogeneity of the material quality.

On the other hand, as the method wherein the gamma to alpha transformation rate is used as a control factor, the present applicants have proposed a method of producing the high strength steel excellent in flatness, featuring an accelerated cooling, in cooling after hot rolling a steel containing 0.005–0.5 wt % C, 0.05–2.0 wt % Si and 0.3–3.0 wt % Mn, in which a gamma to alpha transformation rate on the average from the start of cooling to the end of cooling falling within a range of 1–20 %/s is applied up to the time of the end of cooling where the gamma to alpha transformed fraction of the steel reaches a range of 60–100%, and after the time of the end of cooling, air cooling is applied. However, by this method, the transformation rate during the cooling was not strictly controllable as in the present invention.

SUMMARY OF THE INVENTION

The present invention has been developed to obviate the above described disadvantages of the prior art and has as its object the provision of a method of controlling the cooling of a hot-rolled steel sheet, having a material quality controlling function with high accuracy which has been difficult to attain by the prior art, securing the homogeneity of the material quality in particular and being suitable for making the steel sheets having various material qualities by the cooling, and an apparatus therefor.

To achieve the above-described object, the present invention contemplates a method of controlling the cooling of a hot-rolled steel sheet after hot rolling, as the technical gist thereof is shown in FIG. 1, the method including:

a step of previously determining a target value of a transformation rate required for obtaining mechanical properties ultimately expected from the hot-rolled steel sheet;

a step of detecting a gamma to alpha transformed fraction of the hot-rolled steel sheet in a section, in which the cooling is controlled by a transformed fraction detector;

a step of measuring an elapsed time from the start of cooling;

a step of calculating the transformation rate of the steel sheet in the cooling stage from the gamma to alpha transformed fraction and the elapsed time; and a step of controlling the conditions of cooling so that the transformation rate in the cooling stage coincides with the target value.

A specific form of the present invention is of such an arrangement that the transformation rate is easily and simply detected such that, when the gamma to alpha transformed fraction is Y(%), an elapsed time from the start of cooling is t(sec), constants determined by chemical components of the steel sheet are K and a, and a value depending upon the transformation rate is n, the value n depending upon the transformation rate being determined through an equation shown below, $$Y=\exp\left[-\{(K-t)/a\}^{n}\right]\times 100 \quad (1)$$

Subsequently, the elapsed time t regarded as the time of the completion of transformation is calculated through the above equation by use of n thus determined and the gamma to alpha transformed fraction regarded as the substantial completion of transformation, and the transformation rate is calculated by use of the elapsed time t thus calculated.

Another object of the present invention is to provide an arrangement wherein the transformation rate is replaced by the time period required for the proceeding of the gamma to alpha transformation such as, for example, "the time period required from the start of the transformation to the completion" or "the time period required for the proceeding of the transformed fraction from 20% to 80%", whereby the calculation is facilitated, so that the same effect as in the case, where the transformation rate is made to be a control factor.

A further object of the present invention is to provide an arrangement wherein the control of the cooling conditions is performed during threading of the hot-rolled steel sheet so that satisfactory control can be performed from the midway of the hot-rolled steel sheet.

A still further object of the present invention is to provide an arrangement wherein the control of the cooling conditions is reflected in the setting of the cooling conditions of a succeeding hot-rolled steel sheet, so that satisfactory control can be performed from the top end of the succeeding hot-rolled steel sheet.

A yet further object of the present invention is to provide an arrangement wherein the cooling water flowrate or the cooling time period in a section in which the cooling is controlled, is varied in proportion to a deviation value between a measured value and the target value of the transformation rate so as to perform the control of the cooling conditions, thus the control of the cooling conditions can be easily and reliably performed.

To achieve the above-described objects, the present invention contemplates a system for controlling the cooling of a hot-rolled steel sheet after hot rolling, the system including:

means for setting a target value of a transformation rate required for obtaining predetermined mechanical properties ultimately expected from the hot-rolled steel sheet;

a transformed fraction detector for detecting the rate of gamma to alpha transformed fraction of the hot-rolled steel sheet in a section in which the cooling is controlled;

means for measuring an elapsed time from the start of cooling;

means for calculating the transformation rate of the steel sheet in the cooling stage from the rate of gamma to alpha transformed fraction and the elapsed time; and means for controlling the cooling conditions so that the transformation rate in the cooling stage coincides with the target value.

A specific object of the present invention is to provide an arrangement wherein the transformed fraction detector includes:

an exciting coil disposed on either side of the hot-rolled steel sheet and capable of generating alternating magnetic fluxes by an alternating current exciter;

two or more detection coils disposed on the same side as the exciting coil, arranged at positions of varying distance from the exciting coil and mutually induced by the exciting coil; and a calculator for calculating the transformed fraction of the hot-rolled steel sheet from a difference in detection signal due to a difference in interlocking magnetic flux quantity in the respective detection coils;

whereby the transformed fraction required for the control according to the present invention can be reliably detected.

The invention has been created by the present applicants on the basis of the discovery of a close relationship between the gamma to alpha transformation rate of a steel sheet during the cooling and the mechanical properties of the hot-rolled steel sheet after the cooling, as a result of devoted studies of the relationship between the behavior of transformation during the cooling and the material quality of the steel, by use of the detectors for detecting the transformed fraction as proposed by the present applicants in Japanese Patent Application No. 64147/1983, which corresponds to U.S. patent application Ser. No. 658,606, Canadian Patent Application No. 465,120, European Patent Application No. 84112092.6 and Korean Patent Application No. 6253/1984.

Description will hereunder be given referring to the results of studies made by the present inventors on the relationship between the transformation rate and the mechanical properties, which relationship is the technical basis of the present invention.

Table 1 shows the contents of steels A–D, and Ceq in Table 1 indicates numerical values calculated through an equation shown below.

$$Ceq=C+Mn/6+Si/10$$

The steels A–D as shown in Table 1 were finish-rolled by a finish rolling mill at a finish temperature of 850° C., and thereafter were subjected to the cooling under the cooling conditions where the transformation rate was consciously varied within the ranges of 6–70%/sec for the steel A, 3.5–25%/sec for the steel B, 2.8–10.0%/sec for the steel C and 2.4–8%/sec for the steel D, and the hot-rolled steel sheets 12 (FIG. 1) each having a thickness of 3.2 mm were produced.

TABLE 1

| Steel | C | Si | Mn | P | S | Al | Ceq |
|---|---|---|---|---|---|---|---|
| A | 0.06 | 0.15 | 0.62 | 0.013 | 0.011 | 0.025 | 0.178 |
| B | 0.12 | 0.01 | 0.87 | 0.015 | 0.007 | 0.031 | 0.265 |
| C | 0.16 | 0.06 | 1.12 | 0.014 | 0.008 | 0.013 | 0.353 |
| D | 0.20 | 0.21 | 1.33 | 0.015 | 0.007 | 0.033 | 0.443 |

FIG. 2 shows the results of study of the relationship between the average transformation rate from the start of transformation to the completion during the cooling as measured by the transformed fraction detectors A1–A8 and the tensile strength of the hot-rolled steel sheet 12 after the cooling, on the various steels shown in Table 1. For the purpose of comparison, FIG. 3 shows the results of study of the relationship between the coiling temperature as being a control factor of the cooling conditions in the prior art and the tensile strength after the cooling.

From the comparison of FIGS. 2 and 3, it is apparent that the degree of corelation with the tensile strength is larger in the case where the transformation rate is made to be a control factor according to the present invention than in the case where the coiling temperature is made to be a control factor in the prior art.

On the basis of the above-described results, the present applicants have found the method of controlling the cooling, in which the transformation rate as being the transformation behavior having direct correlation with the mechanical properties of the steel is made to be a control factor; this method can perform the material quality control more accurately than the method of controlling the cooling which resorts to the measuring of temperature such as the cooling rate, coiling temperature or the like. The present applicants have combined the means for measuring the transformation rate during the cooling used in the "System for Online-Detecting Transformation value and/or Flatness of Steel or Magnetic material" previously proposed in Japanese Patent Application No. 64147/1983, to thereby achieve the present invention.

As a consequence, the information of transformation quantitatively detected on line in the cooling zone is used to control the cooling conditions after hot rolling, so that the controlling accuracy of the cooling conditions can be considerably improved. As a result, the material quality control with high accuracy, which has been difficult to attain by the conventional method, can be conducted, and particularly, the homogeneity of the material quality can be secured and it is possible to make the steel sheets having various material qualities with high accuracy by the cooling.

In other words, according to the present invention, it is possible to control the material quality with high accuracy as compared with the conventional method of controlling the cooling through the control of the coiling temperature, and particularly, the following outstanding advantages can be achieved:

(1) A high strength can be attained by use of a steel having a similar chemical composition without endangering the homogeneity.

(2) With a steel of a type having high C equivalent weight, which has heretofore been difficult to be homogenized by the conventional method, a hot-rolled steel strip excellent in homogeneity can be produced.

(3) Various hot-rolled steel sheets, each having a desired strength, can be produced with high accuracy.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein:

FIG. 6 is a chart showing various cooling conditions and various tensile properties obtained when cooled under the above-described conditions.

DETAILED DESCRIPTION OF THE INVENTION

Detailed description will hereunder be given of one embodiment of the present invention with reference to the drawings.

Figure 4:
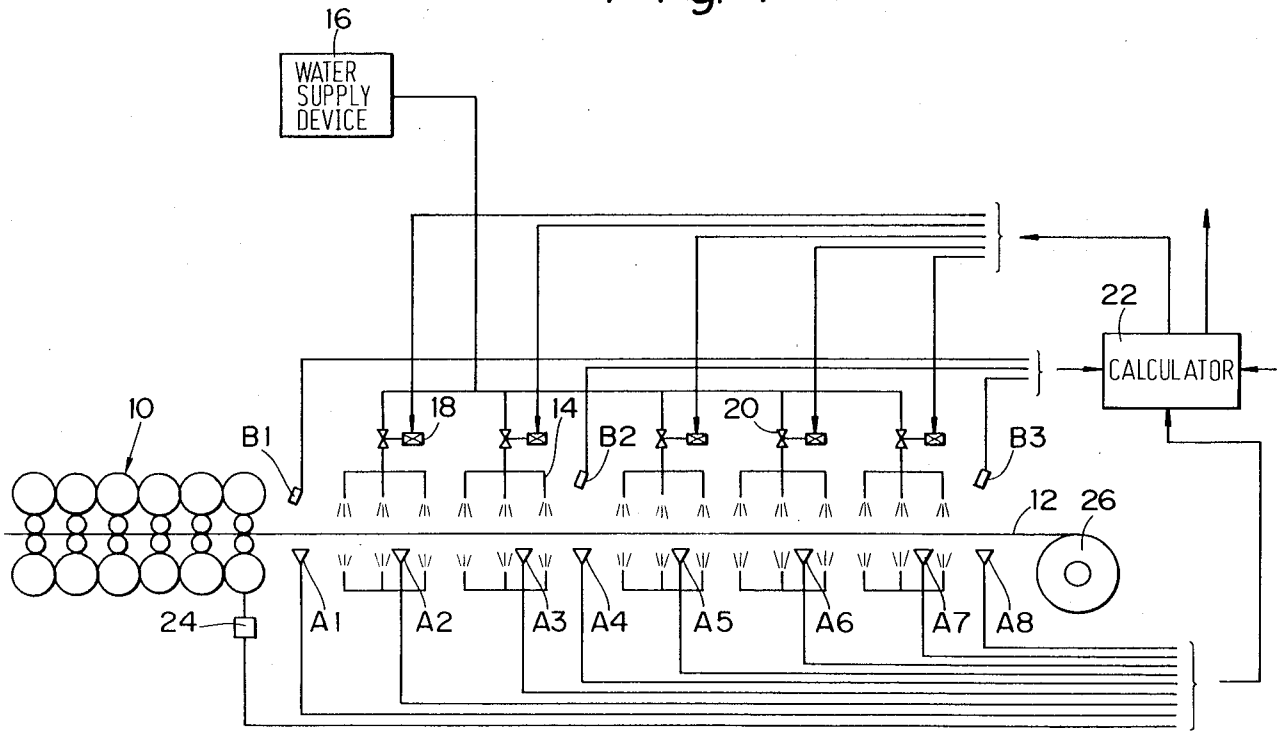
FIG. 4 is a block diagram showing the outline of the cooling line, to which is applied an embodiment of the method of controlling the cooling of a hot-rolled steel sheet according to the present invention.

Firstly, processes of manufacture for working the method according to the present invention will be described. Referring to FIG. 4, designated at 10 is a finish rolling mill within a hot-rolling process, 12 a hot-rolled steel sheet, and 14 a water pouring device for pouring the cooling water for cooling a hot-rolled steel sheet 12 onto the steel sheet 12 in forms of mist, jet, pipe laminar flow or slit laminar flow, for example. The cooling water is fed from a water supply device 16, adjusted in flowrate by a water flowrate adjusting valve 20 driven in accordance with the instructions of a valve controller 18, and thereafter, poured onto the hot-rolled steel sheet 12 through the water pouring device 14. Denoted at A1–A8 are the transformed fraction detectors which quantitatively detect the gamma to alpha transformed fraction of the hot-rolled steel sheet 12 passing over the detectors A1–A8 and deliver measurement signals to a calculator 22. The valve controller 18 is connected to the calculator 22 and operated by a control signal from the calculator 22, to thereby adjust the opening degree of the valve 20.

In addition, indicated at 24 is a speedometer for measuring the speed of conveyance of the hot-rolled steel sheet 12 on a runout table, B1 a thermometer for measuring the temperature of finish rolling, B2 a thermometer for measuring an intermediate temperature of the hot-rolled steel sheet 12 on the runout table, B3 a thermometer for measuring the coiling temperature and 26 a coiler.

Any desirable measuring means may be adopted as the transformed fraction detectors A1–A8, provided the means can rapidly and quantitatively online-detect the rate of gamma to alpha transformed fraction of the hot-rolled steel sheet 12. However, in this embodiment, there is used the "System for Online-Detecting Transformation Value and/or Flatness of Steel or Magnetic Material" previously proposed by the present applicants in Japanese Patent Application No. 64147/1983.

Figure 5:
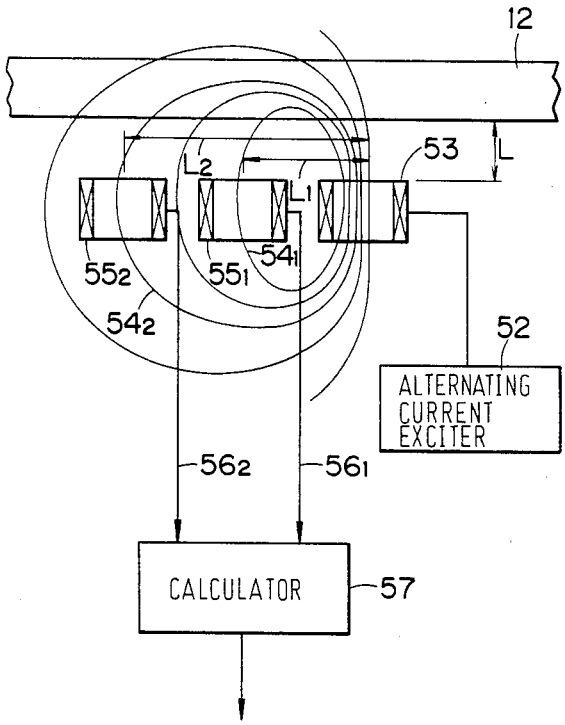
FIG. 5 is a block diagram showing a typical example of a conventional device for detecting the gamma to alpha transformed fraction as used in an embodiment of the method according to the present invention.

These transformation value online detectors A1–A8, as the typical example thereof is shown in FIG. 5, include:

an exciting coil 53 disposed on either one side of the hot-rolled steel sheet 12 as being the material to be measured and capable of generating alternating magnetic fluxes by an alternating current exciter 52;

two or more detection coils $\mathbf{55}_1$ and $\mathbf{55}_2$ disposed on the same side as the exciting coil 53, arranged at positions different in distances $L_1$ and $L_2$ from the exciting coil 53 and mutually induced by the exciting coil 53; and a calculator 57 for calculating the transformed fraction of the steel sheet 12 from a difference in detection signal due to a difference in interlocking magnetic flux quantity in the respective detection coils $\mathbf{55}_1$ and $\mathbf{55}_2$.

In addition, in FIG. 5, designated at $\mathbf{54}_1$ is a magnetic flux generated in the exciting coil 53 and interlocking with the detection coil $\mathbf{55}_1$, and $\mathbf{54}_2$ a magnetic flux interlocking with the detection coil $\mathbf{55}_2$.

The state where the steel sheet 12 does not start the transformation, i.e., in the gamma single phase, the steel sheet is in the paramagnetic state. So, the magnetic fluxes $\mathbf{54}_1$ and $\mathbf{54}_2$, which interlock with the detection coils $\mathbf{55}_1$ and $\mathbf{55}_2$, have constant strengths corresponding to the distances $L_1$ and $L_2$ from the exciting coil 53, respectively, whereby induced voltages in proportion to the distances $L_1$ and $L_2$ are generated respectively (hereinafter referred to as the "initial states").

When gamma to alpha transformation is caused in the steel sheet 12 and the ferromagnetic alpha phase precipitates, the alpha phase is magnetized, a variation is caused to the magnetic field intensity of the steel sheet 12, and the strengths of the magnetic fluxes $\mathbf{54}_1$ and $\mathbf{54}_2$ are shifted from the initial states which are detected as the changes in the induced voltages from the detection coils $\mathbf{55}_1$ and $\mathbf{55}_2$, respectively.

Detection signals $\mathbf{56}_1$ and $\mathbf{56}_2$ of the above-described detection coils $\mathbf{55}_1$ and $\mathbf{55}_2$ are delivered to the calculator 57, whereby the magnitudes in measured signal of the detection coils $\mathbf{55}_1$ and $\mathbf{55}_2$ are compared with each other, so that the transformed fraction of the steel sheet 12 can be determined by the calculator 57.

Figure 1:
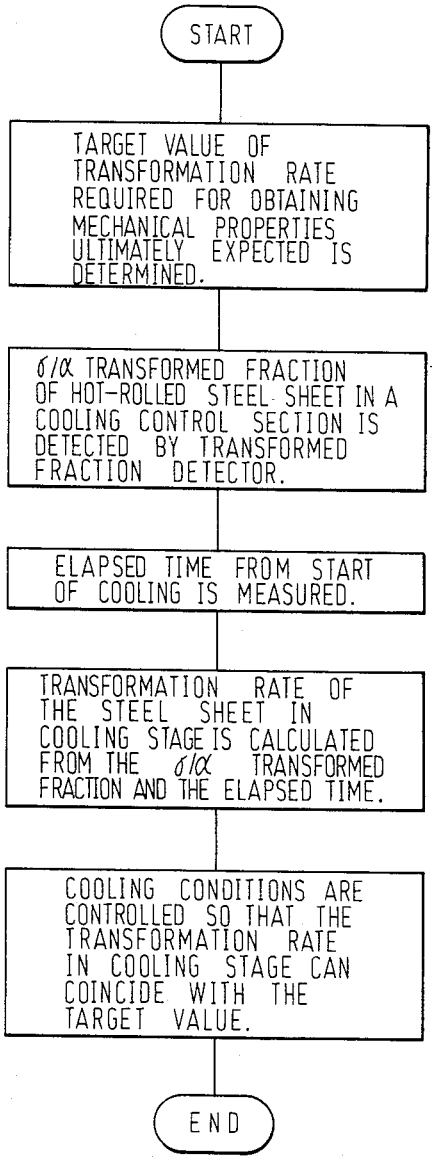
FIG. 1 is a flow chart showing the method of controlling the cooling of a hot-rolled steel sheet according to the present invention.

Description will hereunder be given of one embodiment of the method of controlling. As shown in FIG. 1 above, according to this embodiment, in the method of controlling the cooling of the hot-rolled steel sheet 12 after hot rolling, a target value of the transformation rate required for obtaining mechanical properties ultimately expected from the hot-rolled steel sheet 12 is previously determined, the gamma to alpha transformed fraction of the hot-rolled steel sheet 12 in the section in which the cooling is controlled is detected by the transformation rate detectors A1–A8, the elapsed time from the start of cooling is detected to determine the transformation rate of the hot-rolled steel sheet 12 in the cooling stage, and the conditions of cooling are controlled so that the transformation rate in the cooling stage can coincide with the target value.

In determining the target value of the transformation rate, a target point of the start of transformation and a target point of the end of transformation for achieving the target value of the transformation rate are determined from the speed of conveyance of the hot-rolled steel sheet 12 on the runout table, and this section is made to be the section in which the cooling is controlled and inputted to the calculator. In setting the transformation rate, it is desirable that the relationships between the transformation rate and the mechanical properties of various steel types be previously grasped as will be described hereunder and that the setting be performed on the basis of the relationships.

Detection of the transformation rate is performed in the following manner. Firstly, the cooling is started at a cooling flowrate for a cooling time period and in a cooling pattern, in accordance with the target value of the transformation rate. Subsequently, an actual gamma to alpha transformed fraction of the hot-rolled steel sheet 12 is measured by the transformed fraction detectors A1–A8, and the transformation rate is calculated from the gamma to alpha transformed fraction and the elapsed time from the start of cooling obtained from the speed of conveyance of the steel sheet 12 at that time, and the like.

Needless to say, in calculating the transformation rate, the larger the number of the transformed fraction detectors in the section in which the cooling is controlled, the more accurate the measurement. However, if a measured value is obtained at at least one position in the section in which the cooling is controlled, then it is possible to predict the average transformation rate from the start of transformation to the completion.

Namely, according to the knowledge of the present inventors, in the processing of the transformed fraction on the runout table, if the gamma to alpha transformed fraction is Y(%) and the elapsed time from the start of cooling is t(sec), then the relationship therebetween can be given through the aforesaid equation $Y=\exp[-\{(k-t)/a\}^n]\times 100$.

As a consequence, if the measured value of Y by the transformed fraction rate detectors A1–A8 and the elapsed time t calculated from the speed of conveyance are substituted into the equation (1) to determine n, and subsequently, the value t at the time of the value Y (e.g., Y=99.9%) substantially representing the completion of transformation is calculated by use of the value n above, then the average transformation rate from the start of transformation to the completion can be predicted. The aforesaid of calculation is made by the calculator 22, so that the average transformation rate can be determined from the measurement signal from the transformed fraction detectors A1–A8 and the signal from the conveyance speedometer 24.

The following is the control of the cooling conditions performed such that the transformation rate in the cooling stage takes the approximate target value of the transformation rate. More specifically, the measured value of the transformation rate, determined as described above, is compared with the initially determined target value. When the measured value of the transformation rate is smaller than the target value, the cooling water flowrate or the cooling time period in the cooling control section is increased in proportion to the deviation value through the valve controller 18 and the water flowrate adjusting valve 20 so as to increase the transformation rate, and when the measured value of the transformation rate is larger than the target value, the cooling flowrate or the cooling time period is decreased in proportion to the deviation value through the valve controller 18 and the water flowrate adjusting valve 20 so as to decrease the transformation rate, so that the cooling conditions in the cooling control section can be corrected to approximate the target transformation rate.

Correction of the cooling conditions may be performed during threading of the hot-rolled steel sheet 12, or may be reflected in the setting of the cooling conditions of a succeeding hot-rolled steel sheet 12.

Additionally, the meaning of the transformation rate used in this specification is used in a broad concept including the cases where the transformation rate may be replaced by a time period required for the proceeding of the transformation such as, for example, "the required time period from the start of the transformation to the completion" or "the time period required for the proceeding of the gamma to alpha transformed fraction from 20% to 80%".

Description will hereunder be given of a comparison between the effect of controlling the material quality of the hot-rolled steel strip as produced according to the present invention with the result of production according to the conventional method.

Steels A–D shown in Table 1 are used, finish-rolled into steel sheets each having a thickness of 3.2 mm under the finish rolling temperature of 850° C., and thereafter coiled after cooling by the control of cooling according to the method of the present invention, where the transformation rate is made to be the control index, and by the control of cooling according to the conventional method, where the coiling temperature is made to be the control index, and under the respective conditions of the cooling control targets, which will be described hereunder. FIG. 6 is a chart showing a target tensile strength, target cooling conditions, actual results of cooling conditions, and tensile properties obtained when the cooling is performed under these cooling conditions.

Figure 2:
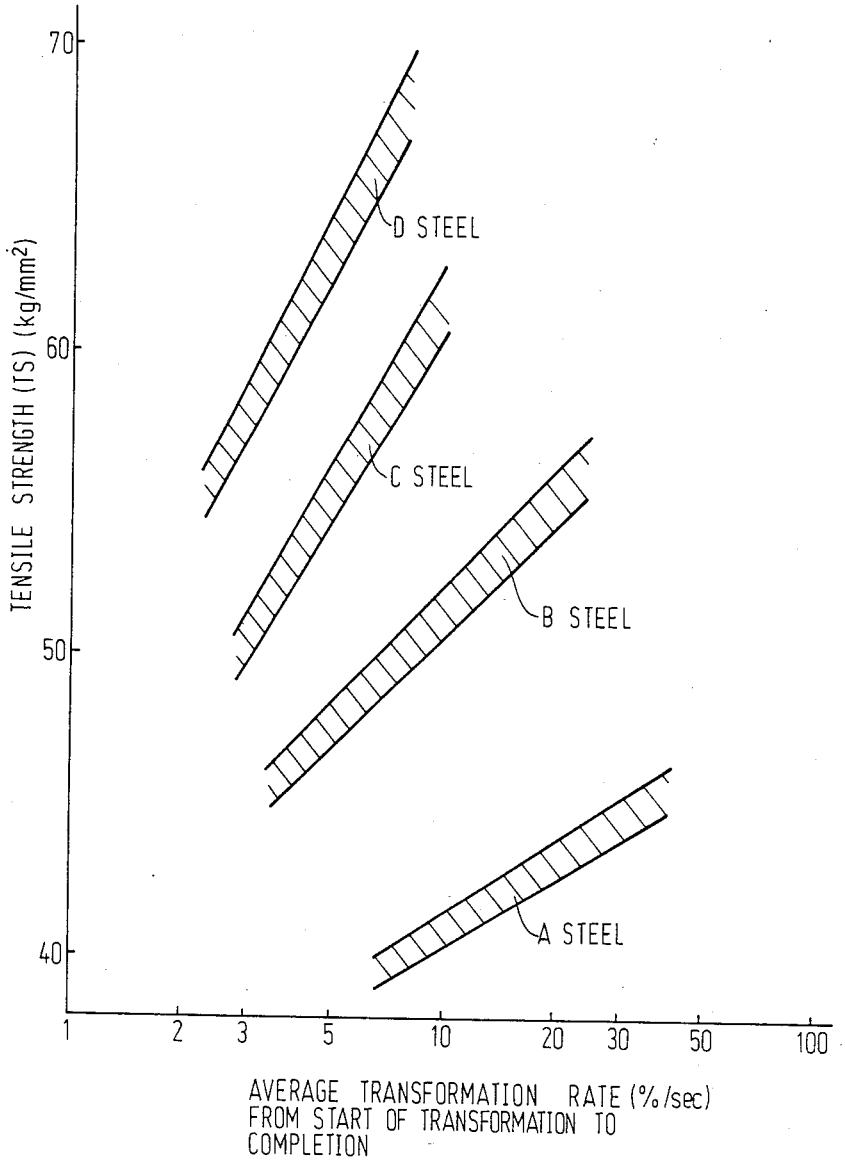
FIG. 2 is a graphic chart explaining of the principle of the present invention, showing the relationship between the average transformation rate from the start of transformation to the completion and the tensile strengths of the hot-rolled steel sheets after the cooling.
Figure 3:
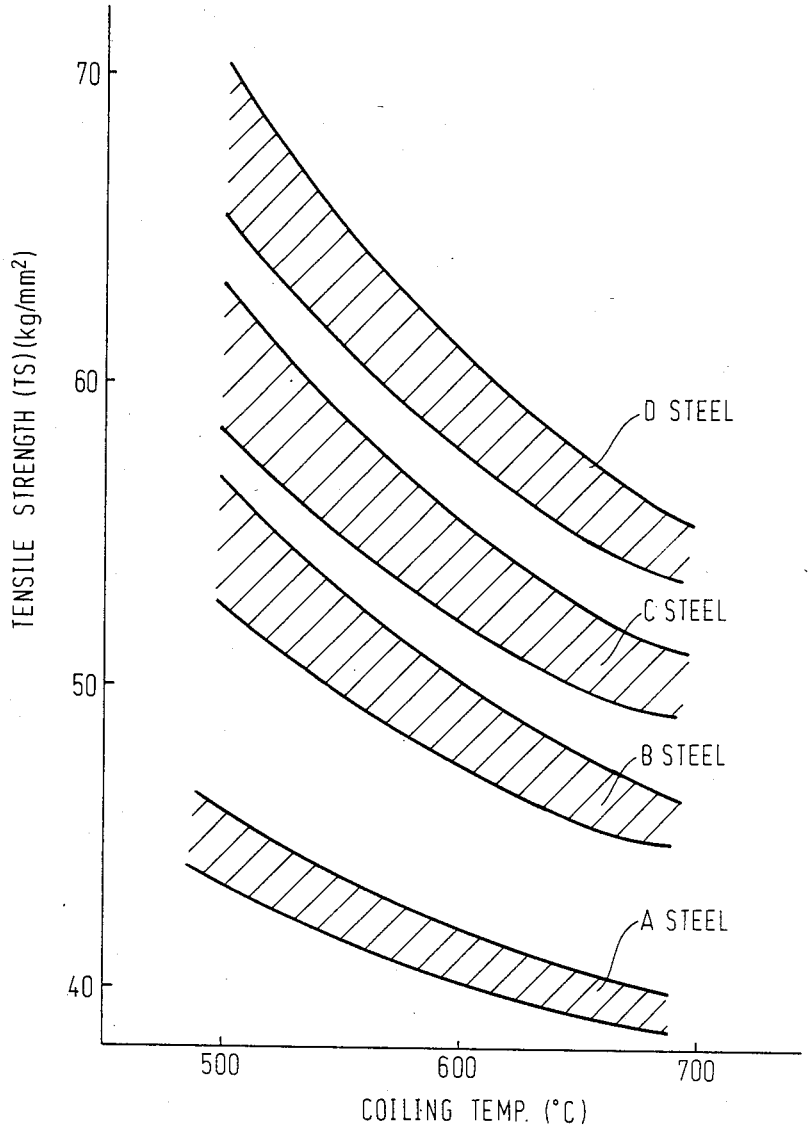
FIG. 3 is a graphic chart showing the relationship between the coiling temperature as being the control factor of the cooling conditions in the prior art and the tensile strengths of the hot-rolled steel sheets after the cooling.

In addition, as for the respective conditions of the cooling control targets, in order to obtain the target tensile strengths with every steel on the three levels shown in FIG. 6 in the case of the present invention, the target value of the transformation rate required from the view of the relationship between the tensile strength and the transformation rate as shown in FIG. 2 is determined, and, in the case of the conventional method, the target value of the coiling temperature required from the view of the relationship between the tensile strength and the coiling temperature as shown in FIG. 3 is determined.

Furthermore, the tensile properties were examined by use of a tensile specimen of JIS (Japan Industrial Standard) 5 on the hot-rolled steel strip manufactured as described above at positions obtained by dividing the hot-rolled steel strip into twenty portions in the lengthwise direction of rolling. The results of the examination of the tensile properties are shown in FIG. 7 as the variation values of the tensile strengths in the coil.

Figure 7:
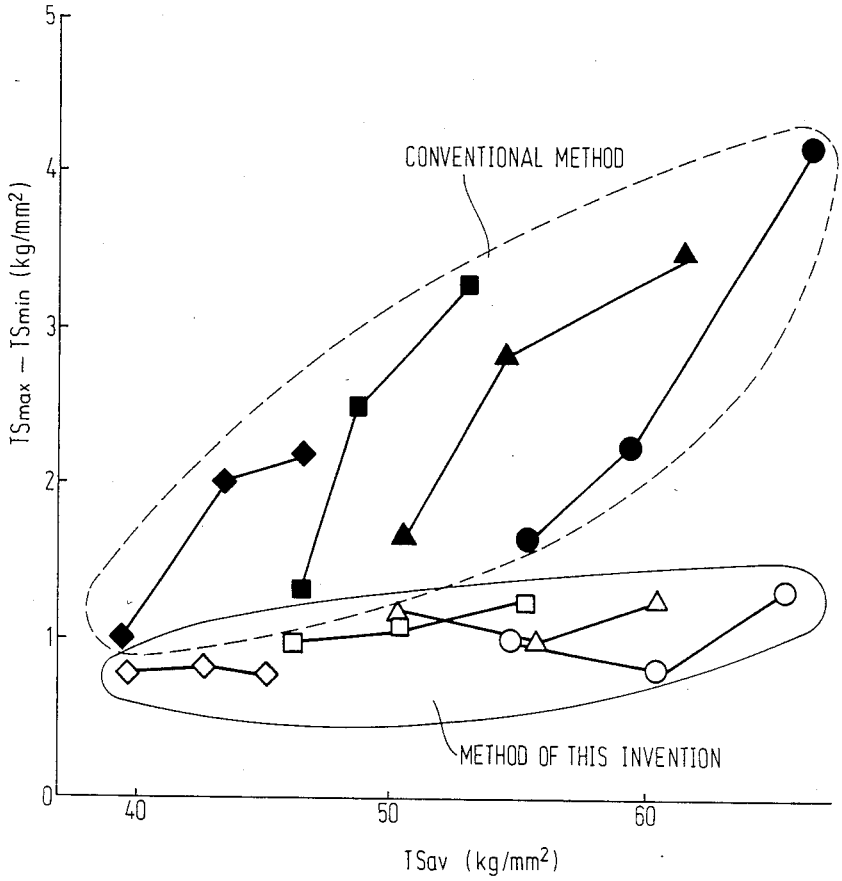
FIG. 7 is a graphic chart showing the values of variation in tensile strength between the conventional method and the method according to the present invention, with regard to the hot-rolled steel strip produced under the conditions of cooling as shown in FIG. 6.

In FIG. 7, the abscissa represents a mean value (TS av) of the tensile strengths at twenty points in the coil, and the ordinate indicates a value obtained by subtracting the minimum value (TS min) of the tensile strengths at twenty points in the coil from the maximum value (TS max) of the tensile strengths at twenty points in the coil.

As apparent from FIG. 7, in the case of the production according to the conventional method, with steels having the chemical compositions identical with each other, there is a tendency that the variation value of tensile strength in the material is increased with the increase of the target tensile strength. In comparison between the steel types different from each other, there is a tendency that the higher the C equivalent weight in the steel type, the larger the variation value of tensile strength in the steel type. With the examples produced by the method according to the present invention, it is found that, in either case, the variation value of the tensile strength in the material is small, and a hot-rolled steel strip high in homogeneity can be produced.

What is claimed is:

1. A method of controlling the cooling of a hot-rolled steel sheet after hot rolling, comprising:

determining a target value of a transformation rate required for obtaining mechanical properties ultimately expected from said hot-rolled steel sheet;

determining the fraction of gamma to alpha transformation of said hot-rolled steel sheet, in a section in which the cooling is controlled, by at least one transformed fraction detector;

measuring an elapsed time from the start of cooling;

calculating the transformation rate of said steel sheet in the cooling stage from the gamma to alpha transformed fraction and the elapsed time; and controlling the conditions of cooling so that the transformation rate in the cooling stage coincides with said target value.

2. A method of controlling the cooling as set forth in claim 1, wherein when the gamma to alpha transformed fraction is Y(%), an elapsed time from the start of cooling is t(sec), constants determined by chemical components of said steel sheet are K and a, and a value depending upon the transformation rate is n, said value n depending upon the transformation rate is determined through the equation:

$$Y=\exp\left[-\{(K-t)/a\}^n\right]\times 100,$$

subsequently said elapsed time t regarded as the time of the completion of transformation is calculated through said equation by use of n thus determined and the gamma to alpha transformed fraction regarded as the substantial completion of transformation, and the transformation rate is calculated by use of said elapsed time t thus calculated.

3. A method of controlling the cooling as set forth in claim 1, wherein said transformation rate is replaced by a time period required for the proceeding of the transformation.

4. A method of controlling the cooling as set forth in claim 3, wherein said time period required for the proceeding of the transformation is a time period required from the start of the transformation to the completion.

5. A method of controlling the cooling as set forth in claim 3, wherein said time period required for the proceeding of the transformation is a time period required for the proceeding of the gamma to alpha transformed fraction from 20% to 80%.

6. A method of controlling the cooling as set forth in claim 1, wherein the control of said cooling conditions is performed during threading of said hot-rolled steel sheet.

7. A method of controlling the cooling as set forth in claim 1, wherein the control of said conditions of cooling is reflected in the setting of the cooling conditions of a succeeding hot-rolled steel sheet.

8. A method of controlling the cooling as set forth in claim 1, wherein the control of said cooling conditions is performed by changing a cooling water flowrate or a cooling time period, in a section in which the cooling is controlled, in proportion to a deviation value between a measured value and the target value of the transformation rate.

9. A system for controlling the cooling of a hot-rolled steel sheet after hot rolling, comprising:

means for setting a target value of a transformation rate required for obtaining predetermined mechanical properties ultimately expected from said hot-rolled steel sheet;

at least one transformed fraction detector for determining the fraction of gamma to alpha transformation of said hot-rolled steel sheet in a section in which the cooling is controlled;

means for measuring an elapsed time from the start of cooling;

means for calculating the transformation rate of said steel sheet in the cooling stage from the rate of gamma to alpha transformed fraction and said elapsed time; and means for controlling the cooling conditions so that the transformation rate in the cooling stage coincides with said target value.

10. A system for controlling the cooling as set forth in claim 9, wherein said transformed fraction rate detector includes:

an exciting coil disposed on either side of said hot-rolled steel sheet and capable of generating alternating magnetic fluxes by an alternating current exciter;

a plurality of detection coils disposed on the same side as said exciting coil arranged at positions of varying distance from said exciting coil and mutually induced by said exciting coil; and a calculator for calculating the transformed fraction of said hot-rolled steel sheet from a difference in detection signal due to a difference in interlocking magnetic flux quantity in the respective detection coils.

* * * * *